United States Patent [19]

Bellis et al.

[11] 4,078,788

[45] Mar. 14, 1978

[54] SHEET FEEDER

[75] Inventors: Carlo Bellis, Strambino (Turin); Giamattista Giovando, Ivrea (Turin); Ivo Mulatero, Turin, all of Italy

[73] Assignee: Ing. C. Olivetti & C., S.p.A., Ivrea (Turin), Italy

[21] Appl. No.: 745,729

[22] Filed: Nov. 26, 1976

[30] Foreign Application Priority Data

Dec. 3, 1975 Italy ..... 69970/75

[51] Int. Cl.[2] ..... B65H 3/02; B65H 1/12

[52] U.S. Cl. ..... 271/128; 271/160; 271/170; 271/171

[58] Field of Search ..... 271/128, 130, 42, 160, 271/170, 171; 214/8.5 A, 8.5 F

[56] References Cited

U.S. PATENT DOCUMENTS

| | | | |
|---|---|---|---|
| 1,964,498 | 6/1934 | Brasseur | 271/42 |
| 2,044,738 | 6/1936 | Rodman | 271/170 |
| 2,086,138 | 7/1937 | Roque | 271/42 |
| 2,112,341 | 3/1938 | Klemm | 271/42 |
| 2,569,387 | 9/1951 | Robinson | 271/42 |
| 2,960,334 | 11/1960 | Trombetta | 271/160 |
| 3,145,023 | 8/1964 | Cerf et al. | 271/160 X |
| 3,862,753 | 1/1975 | Giorgini | 271/171 |

*Primary Examiner*—Bruce H. Stoner, Jr.
*Attorney, Agent, or Firm*—W. R. Hulbert

[57] ABSTRACT

A sheet feeder for the single feed of sheets from a stack, comprising a first member which moves with a reciprocating motion across the top sheet of the stack, performing a forward stroke from a position of departure to a position of arrival in the direction of feed of the sheets and a return stroke to the position of departure, and a second member which depends pivotably from the first member so as to lean on the top sheet in a direction such that, during the return stroke the second member trails across the top sheet, whereas, in the forward stroke the second member wedges against the top sheet and, during a first part of the forward stroke, sticks to the top sheet and detaches it from the subadjacent sheet of the stack and in the remaining part of the forward stroke advances the top sheet in the direction of feed. The stack is supported in a sheet container having a support plate movable upwardly by a spring biased system of scissors levers. An adjustable lateral edge stop is connected with the spring which biases the scissors levers to vary the tension of the spring with variation of the format of the stack of sheets in the container.

7 Claims, 5 Drawing Figures

SHEET FEEDER

BACKGROUND OF THE INVENTION

The present invention relates to a sheet feeder of the type which pushes sheets one by one off the top of a stack. The invention particularly concerns a sheet feeder which can be used in an electrophotographic copying machine.

It is known that in such machines the copy sheets may be constituted by sheets of paper treated with zinc oxide or in general, coated with a photoconductive layer which sheets, after being passed through successive copying stages such as charging, exposure, development and fixing, constitute finished copies of the original to be reproduced.

Sheet feeders are known which lend themselves poorly to being employed with this type of copy sheet. An example of such feeders is that in which the sheets are stacked in a pile with the photoconductive surface facing upwardly and a rotating roller is placed in contact and pressed from above against the stack of sheets; the first sheet of the stack is therefore advanced because of the higher friction existing between the sheet and roller than that between sheet and sheet.

This type of feeder has the disadvantage that the roller always presses in the same area of the stack, thus spoiling the subjacent sheets, especially those at the bottom of the stack itself, which are repeatedly subjected to the sliding actions between sheet and sheet which unavoidably occur in the said area.

SUMMARY OF THE INVENTION

The object of the invention is therefore to provide an automatic sheet feeder which eliminates the aforesaid disadvantages by distributing the pressure and sliding action over various areas of the stack of sheets.

According to the present invention, there is provided a sheet feeder for the single feed of sheets from a stack, comprising a first member which moves with a reciprocating motion across the top sheet of the stack, peforming a forward stroke from a position of departure to a position of arrival in the direction of feed of the sheets and a return stroke to the position of departure, and a second member which depends pivotably from the first member so as to lean on the top sheet in a direction such that, during the return stroke the second member trails across the top sheet whereas, in the forward stroke the second member wedges against the top sheet and, during a first part of the forward stroke, sticks to the top sheet and detaches it from the sub-adjacent sheet of the stack and in the remaining part of the forward stroke advances the top sheet in the direction of feed.

BRIEF DESCRIPTION OF THE DRAWINGS

The invention will be described in more detail, by way of example, with reference to the accompanying drawings, in which.

DESCRIPTION OF THE PREFERRED EMBODIMENT

Figure 1:
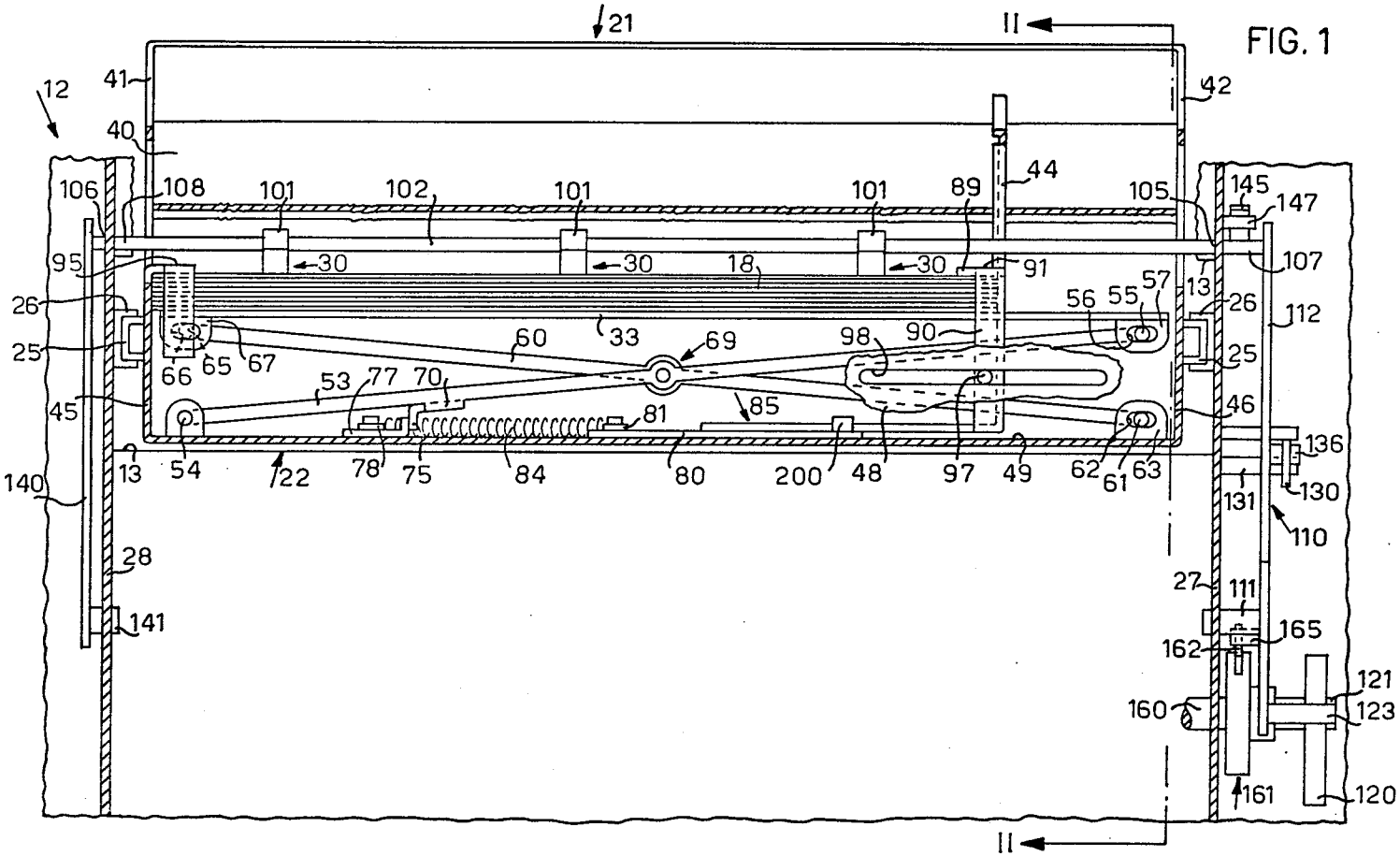
FIG. 1 is a front view of an embodiment of the sheet feeder according to the invention.
Figure 2:
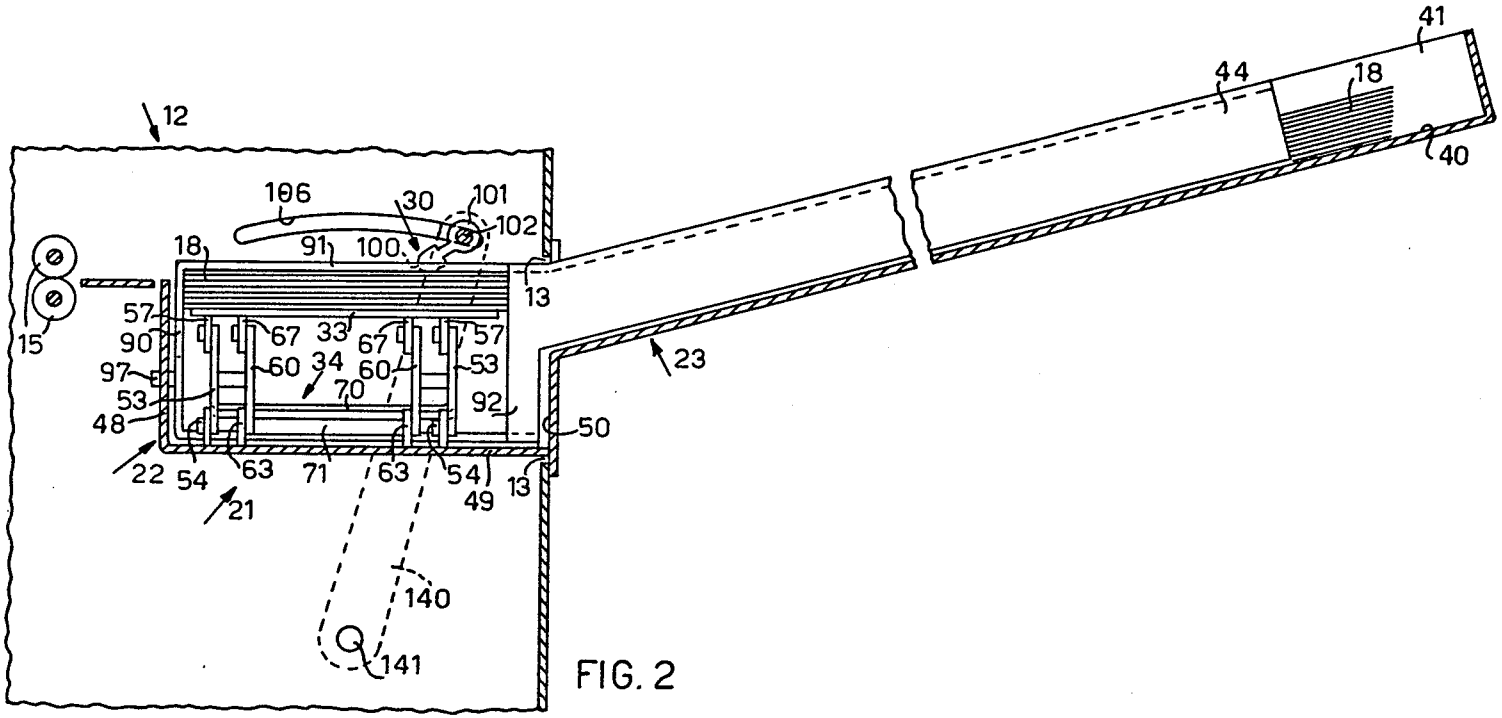
FIG. 2 is a section on the line II—II of FIG. 1.

FIG. 1 and 2 show a feeder embodying the invention mounted on a copying machine 12, of which there can be seen in FIG. 2 the input section comprising an opening 13 and a pair of rollers 15 for advancing the sheets.

The feeder is composed of a tray 21 adapted to contain stacks of sheets 18 of different formats which are to be fed and having a first part 22 which holds the leading ends of the sheets and slides into the machine 12 through the opening 13. To this end the part 22 bears ribs 25 (FIG. 1) adapted to engage with corresponding guides 26 fast with sides 27 and 28 of the input section of the machine 12 for the removable mounting of the tray 21 on the machine through the opening 13. A second part 23 of the tray is fast with the first part 22 (FIG. 2) and inclined with respect to this part for the purpose of facilitating the depletion of the stack 18 contained therein. The tray 21 will be described in detail hereinafter; the feeder further comprises a device for feeding the sheets of the stack, forming part of the copying machine 12 and comprising a series of shoes or fingers 30 disposed above and in contact with the top sheet of the stack and actuated through the medium of a device 31 (FIG. 4) of the machine 12 which imparts to them at each feed cycle a reciprocating movement which, as will be described in detail hereinafter, permits the detachment of the first sheet from the remaining sheets of the stack and the advance thereof to the rollers 15.

Figure 3:
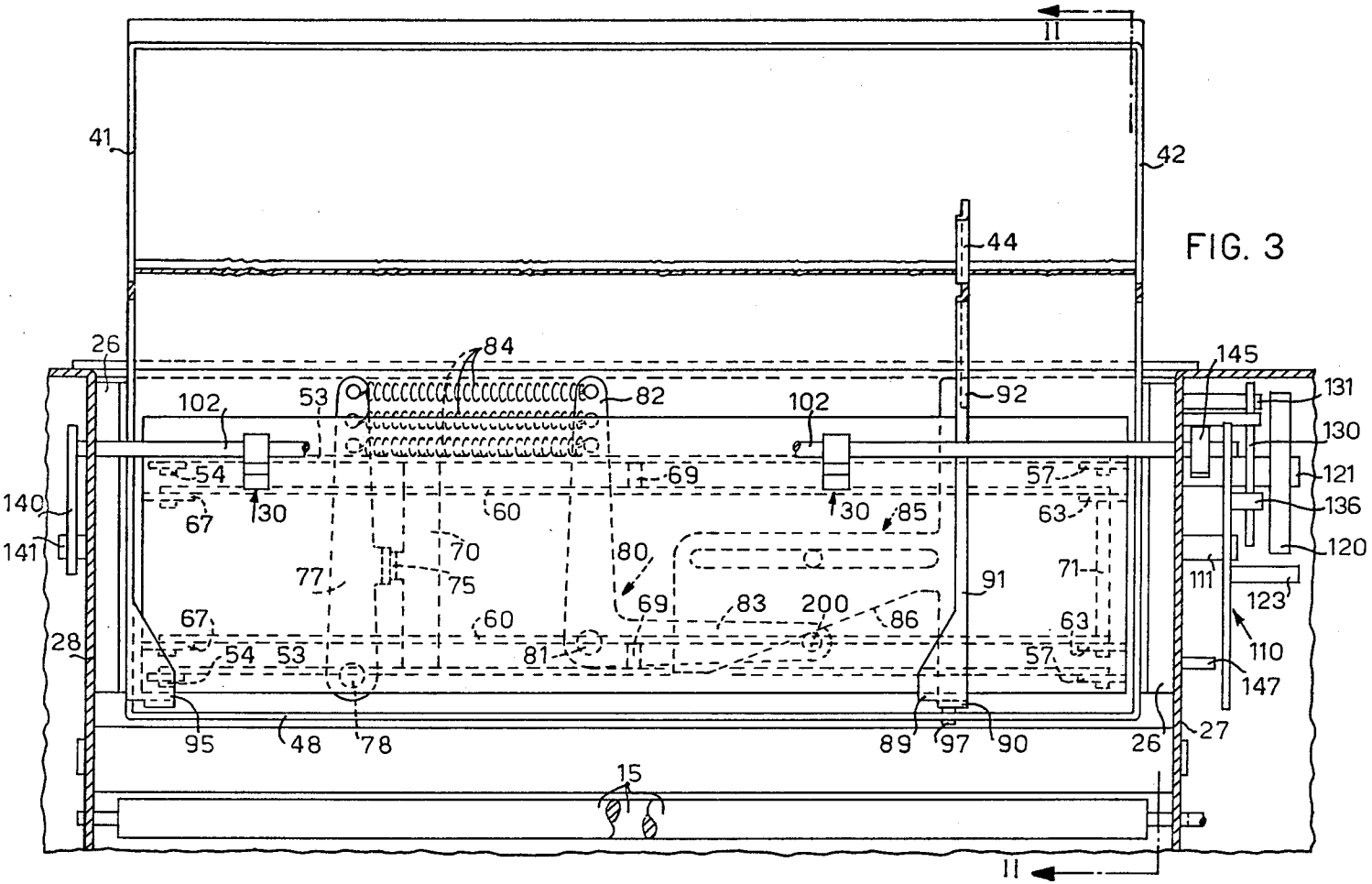
FIG. 3 is a plan view of the feeder of FIG. 1.

A supporting surface 33 is contained in the part 22 of the tray 22 and is adapted to support the front part of the sheets of the stack 18 and is connected to a system of levers 34 also contained in the part 22 and shown in detail in FIGS. 1, 2 and 3 for maintaining the first sheet of the stack 18 constantly in contact with the shoes 30 by pressure, whatever the format of the sheets of the stack 18 and the state of emptying of the tray (that is, the height of the stack 18).

The structure of the tray 21 will now be described in detail. The two parts 22 and 23 (FIGS. 1 and 2) of the tray 21 define a single container for the stack of sheets 18. The part 23 comprises an inclined bottom surface 40, two side walls 41 and 42, of which the wall 41 constitutes a fixed edge stop for the stack of sheets 18, and a movable edge step 44 opposite and parallel to the wall 41 and slidable on the bottom surface 40, for locating the edges of stacks of sheets of different formats.

The part 22 is of substantially parallelepipedal form and is defined laterally by walls 45 and 46, which join up with the walls 41 and 42 of the part 23, and at the front by a front wall 48. The bottom surface 49 of the part 22 is connected to the bottom surface 40 by means of a step 50. Fast with the movable edge stop 44 by means of a flange 91 is a lip 89 which retains one edge of the front part of the sheets of the stack 18.

A lip 95 adapted to retain the other edge of the front part of the sheets of the stack 18 is also integral with the wall 45 forming the fixed edge stop at the junction point with the front wall 48.

As already stated, inside the part 22 there is mounted the surface 33 for supporting the front part of the sheets of the stack. The surface 33 is kept raised with respect to the bottom surface 49 by a system of levers 34 formed by two spaced pairs of scissors levers. The lever system 34 comprises a first pair of levers 53 (FIGS. 1, 2) pivoted at one end on pivots 54 fast with the bottom surface 49 in the proximity of the left-hand side wall 45 and having at the other end a pin 55 free to slide in slots 56 formed in lugs 57 with the underside of the surface 33 in the proximity of its right-hand lateral end; and a second pair of levers 60 having at one end a pin 61 free to slide in slots 62 formed in lugs 63 fast with the bottom surface 49 in the proximity of the side wall 46, and having at the other end a pin 65 free to slide in slots 66 formed in lugs 67 fast with the surface 33 in the proximity of its left-hand lateral end. Each lever 53 therefore intersects with a lever 60 and is connected to the latter where they cross by means of a pin and hole coupling 69, thereby forming scissors levers. Moreover, the levers 53 and 60 of each pair are rendered rigid with one another by connecting crosspieces 70 and 71, respectively, connected to the levers in the proximity of their pivots 54 and 61. The connecting crosspiece 70 is provided with a lug 75.

A lever 77 (FIGS. 1 and 3) is pivoted on a pin 78 fixed to the bottom surface 49 and is free to turn in a plane parallel to the bottom surface 49. The lever 80 pivoted on a pin 81, comprises a first arm 82 and a second arm 83 and a plurality of springs 84 with different elongations are stretched between the lever 77 and the arm 82 of the lever 80. The arm 83 of the lever 80 bears a pin 200 adapted to co-operate with the inclined surface 86 of an element 85 rigid, through the medium of the connecting crosspieces 90, 91, 92 with the movable edge stop 44 and slidable with this stop parallel to the bottom surface 49 to adapt the edge stop 44 to different formats of sheets stacked in the container 21. The crosspiece 90 bears a pin 97 adapted to slide in a slot 98 formed in the front wall 48.

The lever system 34 hereinbefore described operates in the following manner. A stack of sheets of predetermined format positioned on the surface 33 produces a given pressure on the surface 33, tending to depress the same by clockwise rotation of the levers 53 and anticlockwise rotation of the levers 60, in FIG. 1.

This depression or lowering is opposed by the action of the springs 84 which, for a given format and therefore for a given position of the lever 80, have a given elongation and tend to cause the lever 77 to turn clockwise and, because of the engagement of the latter with the lug 75, to cause the lever 53 to turn anticlockwise, therefore tending to raise the surface 33.

The springs 84 are calculated in such manner as to balance the pressure exerted exactly by their elongation, whatever the format of the sheets of the stack 18 which can be contained in the tray 21. During the operations of feeding the sheets the weight of the stack decreases and the surface rises correspondingly because the preceding state of equilibrium has been broken, but since the surface 33 rises and therefore the lever 53 turns anticlockwise, there is a clockwise rotation of the lever 77 pulled by the springs 84 until equilibrium is re-established when the lug 75 co-operates again with the lever 77 and the springs 84 have reduced their elongation so as to re-balance exactly the weight of the sheets remaining on the surface 33 and the weight of the surface itself. The surface 33 therefore rises by an amount proportional to the thickness of the sheets fed, thus always keeping the first sheet of the stack 18 in contact with the shoes 30 of the feed device 31. If sheets of larger formats are used (for example, sheets of greater width), then the movable edge stop 44 is shifted to the right with respect to FIG. 1 and the element 85 will be shifted correspondingly to the right (FIG. 3), whereby because of the engagement of the pin 200 with the inclined surface 86 the lever 80 will be rotated clockwise with respect to the position of FIG. 3 by an amount proportional to the shifting. Consequently, the springs 84 are tensioned to a greater extent for a given position of the surface 33 and, therefore, of the lever 77 so as to compensate for the greater weight of the sheets positioned on the surface 33.

To sum up, considering stacks of an equal number of sheets, the lever 80 and the element 85 impart to the springs an initial elongation, that is with the tray full, which is all the greater the larger the format of the sheets, while the lever 77, the lug 75 and the levers 53 reduce this elongation in proportion to the sheets fed.

The feed device 32 (FIGS. 2, 4) will now be described in detail. This device comprises, as already stated, a plurality of shoes or fingers 30 covered with plastics material or rubber at the end 100 in contact with the sheets to be fed for the purpose of avoiding scratching of the photoconductive layer of the sheets. Each of the shoes 30 has an end 101 fast with a cylindrical rod 102 extending over the entire width of the drawer and guided at its ends 107 and 108 in semicircular slots 105 and 106 formed in the panels 27 and 28 of the machine 12, in which the ends 107 and 108 are free to slide.

A lever 110 is pivoted to the panel 27 of the body of the machine on a pin 111. The lever 110 has a first arm 112 to which is pivoted the end 107 of the rod 102 and a second arm 113 to which is connected one end of a spring 115, the other end of which is connected to a fixed point of the body of the machine 12. The lever 110 is adapted to turn in a plane perpendicular to the surface 33 of the tray 21, so causing the rod 102 to slide along the slots 105 and 106.

At any point of the slots 105 and 106, the distance of the rod 102 from the first sheet of the stack is always less than the length of the shoes 30, so that the shoes 30 are always in contact with the stack because of their own weight, which tends to cause them to turn anticlockwise with respect to the position of FIG. 2.

A cam 120 is mounted rotatably on a spindle 121 parallel to the pin 111. The spindle 121 receives its motion from a driving shaft 160 coaxial with the spindle 121 through the medium of a clutch 161 of known type controlled through a dog 162 which projects from the body of the clutch 161. A pin 165 on the lever 110 is adapted to co-operate with the dog 162 of the clutch 161. A pin 165 on the lever 110 is adapted to co-operate with the dog 162 of the clutch 161 to retain the clutch 161 in the position of non-transmission of the movement of the shaft 160 to the spindle 121 when the lever 110 is in the position of FIG. 4. When the dog 161 is not retained by the pin 165, there is transmission of the movement between the shaft 160 and the spindle 121 for at least one complete revolution. During the rotation of the cam 120, a lobe 122 of the cam 120 is adapted to co-operate with a pin 123 fast with the opposite end of the arm 112. The lobe 122 comprises a first profile 125 of increasing radius and a second profile 126 of decreasing radius. A lever 130 is pivoted on a pin 131 fast with the body of the machine and is connected to the armature 133 of an electromagnet 134. The lever 130 moreover has a tooth 135 adapted to engage with a pin 136 fast with the arm 112 of the lever 110.

The other end 108 of the rod 102 (FIG. 1) is pivoted to a lever 140 pivoted on a pin 141 fast with the panel 28 and coaxial with the pin 111 of the panel 27.

A lug 145 (FIG. 4) is fast with the end 107 of the rod 102. The lug 145 is adapted to co-operate with a pin 147 fixed to the panel 27 of the machine 12 when the levers 110 and 140 are swung anticlockwise with respect to the positions of FIGS. 2–4 to the left-hand end of the slots 105 and 106.

Figures 4, 5:
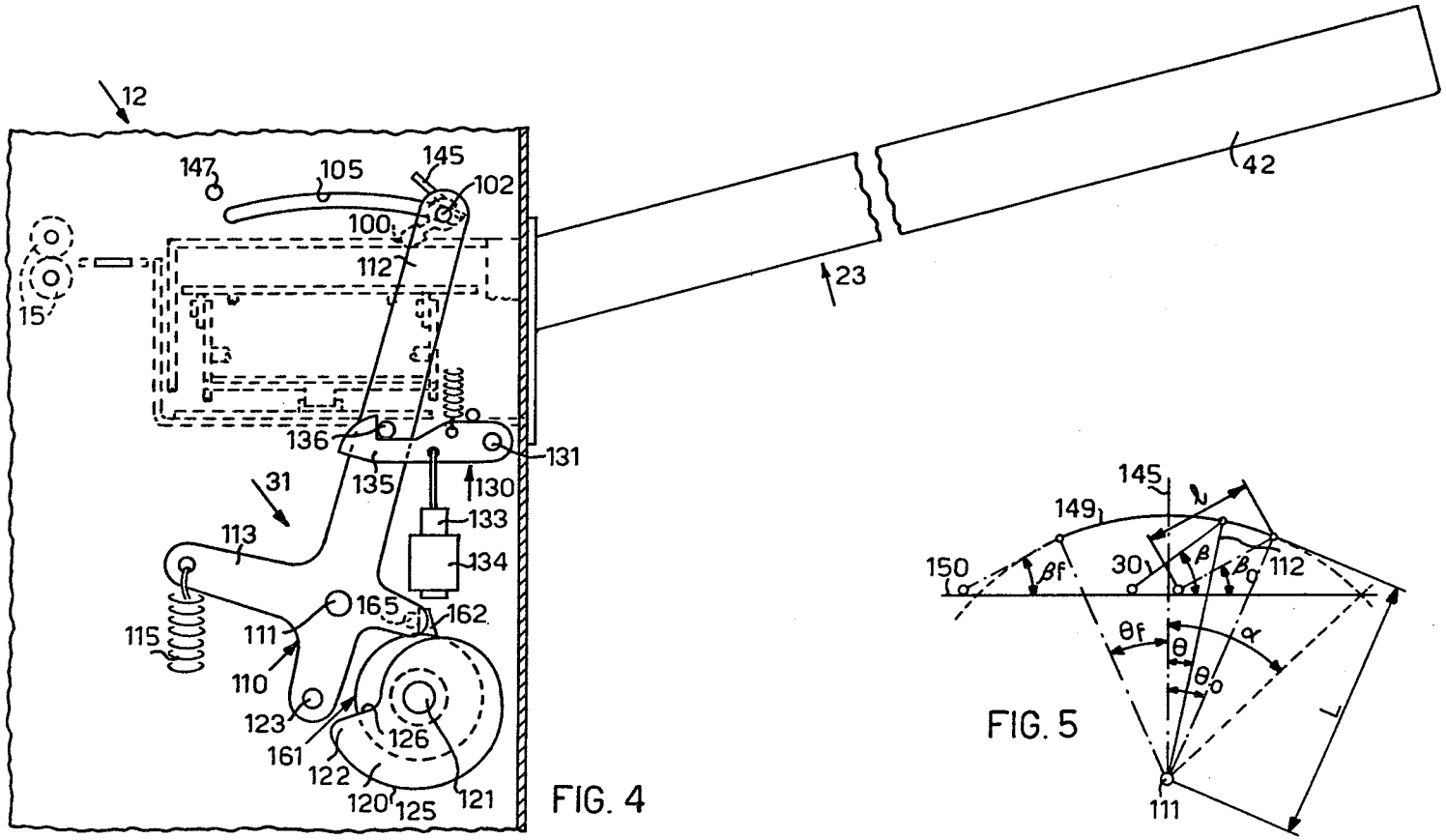
FIG. 4 is a side view from the right of FIG. 1.
FIG. 5 is an illustrative diagram of the feed device of FIG. 1.

Referring to FIGS. 2, 4 and 5, the feed device operates in the following manner. FIG. 5 shows the device diagrammatically without maintaining, for the sake of clarity, the true proportions between the length L of the arm 112 and the length $l$ of the shoe 30. In the inoperative position, the device 31 and the shoes are in the positions of FIGS. 2 and 4, the arm 112 of length L forms an angle $\theta o$ (FIG. 5) with the axis 145 perpendicular to the surface 33 and extending through the pivot 111 and each shoe 30 of length $l$ forms a positive angle $\beta o$ with the plane 150 defined by the first sheet of the stack 18 which is to be fed. The angle $\alpha$ of FIG. 5 indicates the limit position of the arm 112, for which the shoe 30 lies in the plane 150.

The feed cycle begins with the energization of the electromagnet 134, which produces anticlockwise rotation of the lever 130 and the release of the tooth 135 from the pin 136 of the lever 110, so that the lever 110 and, therefore, the arm 112, pulled by the spring 115, turn about their pivot 111, describing the circular arc 149 until arrested against the cam 120; in this position, the arm 112 forms the negative angle $-\theta f$ with the axis 145 and during this rotation the angle that each shoe 30 forms with the plane 150 varies in accordance with the equation $$\sin \beta = (l/L)(\cos \theta - \cos \alpha)$$

with $-\theta \leqq \theta \leqq \theta o$ and $-\theta f < 0$ so that on the decrease of $\theta$ from $\theta o$ to 0 there is an increase in the angle $\beta$ from the initial value $\beta\ o$ to the maximum value (for $\theta = 0$):

$$(o) = \text{arc sin}\ (l/L)(1 - \cos \alpha)$$

while on continuation of the rotation of the lever 112 from $\theta = 0$ to $\theta = -\theta f$ there is decrease in the angle from the maximum value $(o)$ to the value:

$$(-\theta f) = \text{arc sin}\ (l/L)(\cos(-\theta f) - \cos \alpha) = \text{arc sin}\ (l/R)(\cos\theta f - \cos \alpha).$$

In the first stroke portion (from $\theta = \theta o$ to $\theta = o$), there is therefore observed a progressive sticking of the shoes 30 with respect to the first sheet of the stack which causes a greater pressure on the said sheet by the shoes 30, whereby the friction between the shoe and the sheet increases until it becomes greater than that existing between sheet and sheet of the stack, thus permitting the sliding of the first sheet with respect to the subjacent sheet of the stack.

Normally, it happens that the first sheet advances as soon as the shoe is set in motion, but, if this should not happen, the increasing sticking of the shoe causes the same not to persist in sliding on the sheet without advancing it.

Not only the path, but also the evolution in time of the movement has considerable importance for the operation of the device; in fact, in tests carried out by moving the shoe slowly along its path at constant speed, the feed of two superposed sheets has occurred in at least 50% of cases. On the other hand, by commanding the movement of the shoes in an impulsive manner by means of a spring, correct feed of the sheet has been obtained in 99% of cases.

It is considered that this is due to the fact that spring control enables the maximum speed of the shoe to be reached in the period of time in which its sticking action is still increasing, so that in this case it is succeeded in overcoming the friction of primary separation existing between sheet and sheet.

In the first part of advance of the shoes (that with increasing sticking), the portion of the sheet in contact with the shoe is advanced, while the front edge of the sheet is still retained by the front lips 95 and 89, so that in the zone between the front edge and the portion of sheet in contact with the shoes there is created a loop which has a further action of separation of the sheet to be fed from the remaining sheets of the stack, thus avoiding double feed. The movement of the shoe continuing, because of the thrust of the shoe itself and the loop which has been created, the front edge of the sheet is compelled to slide under the front lips and advance towards the feed rollers 15.

At the end of the stroke of the shoes 30, at the moment when the front edge of the sheet is gripped by the feed rollers 15, the lug 145 engages with the pin 147 and cause anticlockwise rotation of the rod 102 and therefore the raising of the shoes 30. At the same time, the pin 165 of the lever 112 is disengaged from the dog 162, releasing the clutch 161 and causing the transmission of the movement from the driving shaft to the cam, which performs a revolution, turning in the direction indicated by the arrow and causing the lever 112 to engage with the hook 130, thus restoring the initial conditions for the execution of a fresh sheet feeding cycle. As the shoes 30 are retracted they trail and therefore drag lightly across the top sheet.

What we claim is:

1. A sheet feeder for the single feed of sheets from a stack along a feed direction, comprising:

a first member, means for pivotally mounting said first member over the stack on a pivot axis parallel to the top sheet of the stack and transversal to the feed direction, a second member connected to said first member and pivotally mounted with said first member to said pivot axis, said second member having an end portion leaning on the top sheet of the stack and a length from said pivot axis to said end portion sufficient to maintain it inclined with respect to the top sheet of the stack at an angle less than 90°, means moving said first member with a reciprocating motion along the feed direction, including a forward stroke from a position of departure to a position of arrival and a return stroke, means for varying said angle by increasing it during a first part of the forward stroke from an initial value at the position of departure to a maximum value sufficient to detach the top sheet from the subadjacent sheets of the stack, a container for the stack of sheets including a supporting surface for a least the front portion of the sheets of the stack a system of scissors levers for holding said supporting surface a spring biasing said scissors levers to urge the supporting surface upwardly a movable lateral edge stop for locating in the container the edges of stacks of different formats, and an element fast with the movable edge stop and connected to the spring for varying the tension of the spring with variation of the format of stack of sheets positioned in said container.

2. In a sheet feeding device according to claim 1, wherein the spring contracts as the supporting surface rises so as to reduce the tension of the spring as each sheet of the stack is fed.

3. In a sheet feeding device having a feed member operable for feeding the top sheet of a stack of sheets selectable among stacks of sheets of different formats, the combination comprising:

a plate for supporting the sheets of the stack, a system of scissors levers for supporting said plate, biasing means for biasing said system of scissors levers to urge the plate upwardly with a variable force, a lateral edge stop selectively movable into one of a plurality of positions, each corresponding to one of said formats, for laterally accommodating the stack positioned on said plate, and means, connected to said lateral edge stop and to said biasing means, for varying said force with the variation of the position of said lateral edge stop.

4. In a sheet feeding device having a feed member operable for feeding the top sheet of a stack of sheets, a removably mounted container for the stack comprising:

a first plate for supporting at least the front portion of the sheets of the stack, a system of scissors levers for supporting said first plate, a spring biasing said system of scissors levers to urge said plate upwardly, a movable lateral edge stop for accommodating in the container stacks of different formats, and means connected to said lateral edge stop and to said spring for varying the tension of said spring with variation of the format of the stack of sheets positioned in said container.

5. In a sheet feeding device according to claim 4, wherein the tension of the spring is reduced as each sheet of the stack is fed.

6. In a sheet feeding device according to claim 4, wherein said spring is connected between a first lever cooperating with said system of scissors levers and a second lever cooperating with said lateral edge stop, said first lever urging said system of scissors levers upwardly under the action of said spring, said second lever increasing the tension of said spring as the lateral edge stop is moved for enlarged format of the stack.

7. In a sheet feeding device according to claim 4, wherein said container further comprises two front edge stops for retaining the front edge of the sheets of the stack at the corners, and a bottom plate, for supporting the rear portion of the sheets of the stack, which is inclined with respect to said first plate for pushing by gravity the front edges of the sheets of the stack against the two front edge stops.

* * * * *

UNITED STATES PATENT AND TRADEMARK OFFICE

CERTIFICATE OF CORRECTION

PATENT NO. : 4,078,788

DATED : March 14, 1978

INVENTOR(S) : Carlo Bellis et al.

It is certified that error appears in the above-identified patent and that said Letters Patent are hereby corrected as shown below:

Column 2, line 46, "step" should be --stop--;

Column 3, line 2, after "57", insert --fast--;

Column 3, line 20, "The lever 80 pivoted" should be --A lever 80 pivoted--;

Column 5, line 31, in the equation, delete the parentheses around "1/L";

Column 5, line 33, the equation should read as follows:

"$-\theta f \leq \theta \leq \theta o$ and $-\theta f < 0$"

Column 5, line 37, in the equation, delete the parentheses around "1/L";

Column 5, line 43, in the equation, delete the parentheses around "1/L";

UNITED STATES PATENT AND TRADEMARK OFFICE

CERTIFICATE OF CORRECTION

PATENT NO. : 4,078,788

DATED : March 14, 1978

INVENTOR(S) : Carlo Bellis et al.

It is certified that error appears in the above-identified patent and that said Letters Patent are hereby corrected as shown below:

Column 5, line 44, in the equation, delete the parentheses around "1/R".

One inventor's name is misspelled; "Giamattista Giovando" should be --Giambattista Giovando--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*